US009109442B2

(12) United States Patent
Forster

(10) Patent No.: US 9,109,442 B2
(45) Date of Patent: Aug. 18, 2015

(54) DOWNHOLE PULSE-GENERATING APPARATUS

(75) Inventor: Ian Forster, Aberdeen (GB)

(73) Assignee: NOV Downhole Eurasia Limited, Aberdeen (GB)

( * ) Notice: Subject to any disclaimer, the term of this patent is extended or adjusted under 35 U.S.C. 154(b) by 304 days.

(21) Appl. No.: 13/586,706

(22) Filed: Aug. 15, 2012

(65) Prior Publication Data

US 2013/0043022 A1 Feb. 21, 2013

(30) Foreign Application Priority Data

Aug. 15, 2011 (GB) ..... 1114011.8

(51) Int. Cl.
*E21B 47/18* (2012.01)

(52) U.S. Cl.
CPC ..... *E21B 47/18* (2013.01)

(58) Field of Classification Search
CPC ..... E21B 47/18; E21B 47/182; E21B 47/185; E21B 47/187; E21B 31/005
USPC ..... 166/249, 301, 177.1, 177.6, 177.7, 178
See application file for complete search history.

(56) References Cited

U.S. PATENT DOCUMENTS

| | | | | |
|---|---|---|---|---|
| 3,735,828 | A * | 5/1973 | Berryman | 175/299 |
| 4,847,815 | A * | 7/1989 | Malone | 367/84 |
| 5,375,098 | A * | 12/1994 | Malone et al. | 367/83 |
| 5,896,938 | A * | 4/1999 | Moeny et al. | 175/1 |
| 6,508,317 | B2 | 1/2003 | Eddison et al. | |
| 7,397,388 | B2 * | 7/2008 | Huang et al. | 340/853.3 |
| 2002/0148606 | A1 * | 10/2002 | Zheng et al. | 166/249 |
| 2003/0086336 | A1 | 5/2003 | Dubinsky | |
| 2006/0249286 | A1 * | 11/2006 | Serdjukov et al. | 166/249 |
| 2009/0065197 | A1 * | 3/2009 | Eslinger | 166/249 |
| 2009/0173492 | A1 * | 7/2009 | O'Malley | 166/249 |
| 2013/0043022 | A1 * | 2/2013 | Forster | 166/244.1 |

FOREIGN PATENT DOCUMENTS

| | | |
|---|---|---|
| GB | 2399921 A1 | 9/2004 |
| WO | 2005042916 | 5/2005 |
| WO | 2008007066 | 1/2008 |

OTHER PUBLICATIONS

Search Report from priority application GB 1114011.8 dated Nov. 9, 2011.

* cited by examiner

*Primary Examiner* — Jennifer H Gay
(74) *Attorney, Agent, or Firm* — JL Salazar Law Firm

(57) ABSTRACT

A downhole apparatus includes a pressure pulse generator and a pulse reflector. The pulse reflector reflects at least a portion of an incident pressure pulse from the generator as a reflected pressure pulse. The apparatus is configured to provide the reflected pressure pulse with a phase shift with respect to the incident pressure pulse. A method of transmitting pressure pulses downhole includes generating a pressure pulse and reflecting at least a portion of an incident pressure pulse at a pulse reflector as a reflected pressure pulse. A phase shift of the reflected pressure pulse with respect to the incident pressure pulse is controlled.

31 Claims, 7 Drawing Sheets

DOWNHOLE PULSE-GENERATING APPARATUS

CROSS-REFERENCE TO RELATED APPLICATION

This application claims the benefit of GB Patent Application No. 1114011.8, filed on Aug. 15, 2011, the entire contents of which are hereby incorporated by reference.

FIELD OF THE INVENTION

This invention relates to a downhole apparatus for controlling pressure pulses generated downhole; and associated methods; and, in particular, but not exclusively, for limiting a transmission of pressure pulses generated by a Pulse Generator.

BACKGROUND OF THE INVENTION

In oil and gas operations, pressure pulses are often generated downhole. The pressure pulses can result from the operation of equipment such as valves or drilling equipment. The pressure pulses are useful for various functions, such as transmitting signals (e.g. MWD), activating equipment or improving drilling. For example, the applicant has proposed various arrangements for using pressure pulses to provide agitation of a downhole tubing string for a variety of purposes: see, for example, International Patent Applications PCT/GB2007/002553 and PCT/GB2004/004503, the disclosures of which are incorporated herein by reference.

To increase efficacy of the pressure pulses, it is generally desirable to use maximum pressure pulses. For example, for improved efficiency whilst drilling, it is often preferred to have an increased amplitude of pressure pulse to increase agitation. Similarly, an increased amplitude can help lengthen a distance over which a signal can be detectably transmitted, such as using MWD. However, an increased amplitude of pressure pulse can have a disadvantageous side-effect. For example, it is not always desirable to have both an increased distance over which a signal can be transmitted and an increased agitation.

SUMMARY OF THE INVENTION

According to a first aspect of the invention there is provided a downhole apparatus comprising:

a pressure pulse generator; and a pulse reflector for reflecting at least a portion of an incident pressure pulse from the generator as a reflected pressure pulse;

wherein the apparatus is configured to control a phase shift of the reflected pressure pulse with respect to the incident pressure pulse.

The apparatus may be configured to provide the reflected pressure pulse with a phase shift with respect to the incident pressure pulse.

The apparatus may be configured to provide the reflected pressure pulse with substantially no phase shift with respect to the incident pressure pulse.

The generator may comprise a downhole drilling tool. The generator may comprise an agitator.

The phase shift may be a fraction of a period of the generated pulse. The phase shift may be substantially a half of the period of the generated pulse. The phase shift may be substantially a quarter of the period of the generated pulse. The apparatus may be configured such that the reflected pressure pulse is substantially in antiphase with the incident pressure pulse. The phase shift may be substantially a half-wavelength of the incident pressure pulse. The phase shift may be substantially a quarter-wavelength of the incident pressure pulse.

Alternatively, the phase shift may be negligible, such as substantially no phase shift.

The apparatus may be configured to reduce a constructive interference, such as a constructive interference between the incident and reflected pulses. The apparatus may be configured to prevent a constructive interference. The apparatus may be configured to generate a destructive interference. The apparatus may be configured to increase destructive interference. For example, the apparatus may be configured to reduce pressure pulses, such as pressure pulses reaching surface equipment.

The apparatus may be configured to prevent a destructive interference. The apparatus may be configured to generate a constructive interference. The apparatus may be configured to increase constructive interference. For example, the apparatus may be configured to enhance pressure pulses, such as pressure pulses reaching a target location downhole (e.g. a target boring or reaming location such as associated with the pulse generator).

The phase shift may be predetermined.

The apparatus may be configured to direct the reflected pressure pulse towards the generator. The pulse reflector may be located uphole of the generator. The apparatus may be configured to direct the reflected pressure pulse downhole. The pulse reflector may be located downhole of the generator. The apparatus may be configured to direct the reflected pressure pulse uphole.

The apparatus may be configured to protect equipment, such as to protect surface/downhole equipment from undesired vibration; and/or the apparatus may be configured to enhance vibrations, such as at an agitation site; with the pulse reflector.

The apparatus may comprise a plurality of pulse reflectors. For example, the apparatus may comprise a first pulse reflector, and a second pulse reflector. The first pulse reflector may be located uphole of the pulse generator, and the second pulse reflector may be located downhole of the pulse generator. Alternatively, the second pulse reflector may be located uphole of the pulse generator and the first pulse reflector may be located uphole of the second pulse reflector. The apparatus may be configured to provide a first reflected pulse from the first pulse reflector with a phase shift, and a second reflected pulse from the second pulse reflector with substantially no phase shift.

The apparatus may comprise multiple uphole and/or downhole pulse reflectors. For example, the apparatus may comprise multiple pulse reflectors distributed in respective branches of bores; and/or multiple pulse reflectors in a single bore.

The portion of the incident pressure pulse may comprise substantially all of the incident pressure pulse.

The apparatus may be configured such that the incident pressure pulse and the reflected pressure pulse are substantially out of phase. The apparatus may be configured such that the incident pressure pulse and the reflected pressure pulse are never substantially in phase. The apparatus may be configured such that the incident pressure pulse and the reflected pressure pulse are not substantially in phase in a same direction.

The apparatus may be configured such that the incident pressure pulse and the reflected pressure pulse are substantially in phase. The apparatus may be configured such that the incident pressure pulse and the reflected pressure pulse are always substantially in phase. The apparatus may be configured such that the incident pressure pulse and the reflected pressure pulse are substantially in phase in a same direction.

The apparatus may comprise a separation between the generator and the pulse reflector. The separation may be defined by a path of the pressure pulse between the generator and the pulse reflector. The apparatus may be configured such that the incident pressure pulse and the reflected pressure pulse are not in phase at any point along the separation.

The apparatus may be configured to adapt at least one of the separation of the baffle/pulse reflector from the pulse generator, or an output of the pulse generator; on the basis of the other of: the separation of the pulse reflector from the pulse generator, and/or the output of the pulse generator.

The output of the pulse generator may comprise a generated pulse attribute.

The apparatus may be configured to adapt the separation to provide the reflected pressure pulse with a phase shift with respect to the incident pressure pulse. The apparatus may be configured to adapt the generated pulse attribute to provide the reflected pressure pulse with a phase shift with respect to the incident pressure pulse.

The apparatus may be configured to adapt one of:

the separation; or the generated pulse attribute;

on the basis of the other of the generated pulse attribute or the separation.

The apparatus may be configured to adapt at least one of:

the separation; and/or the pressure pulse generator;

to accommodate a speed of the incident pressure pulse between the generator and the pulse reflector.

The separation may be predetermined. The separation may be predetermined according to an incident pressure pulse attribute. The separation may be adaptable according to an incident pressure pulse attribute.

The incident pressure pulse attribute may comprise a frequency. The incident pressure pulse attribute may comprise an amplitude. The incident pressure pulse attribute may comprise a wavelength. The incident pressure attribute may comprise a speed, such as a speed of the incident pressure pulse between the generator and the pulse reflector.

The generator may be adaptable according to an incident pressure pulse attribute.

The separation may be configured to accommodate a transmission medium between the generator and the pulse reflector. The transmission medium may comprise a fluid.

The separation may be determined according to a transmission medium attribute. The separation may be predetermined according to the transmission medium attribute. The transmission medium attribute may comprise a speed of transmission of the pressure pulse. The transmission medium attribute may comprise a density. The transmission medium attribute may comprise a proportion of components constituting the transmission medium. The transmission medium attribute may comprise a rate of flow of the transmission medium. The apparatus may comprise a transmission medium monitor.

The apparatus may be configured to adapt at least one of:

the separation; and/or the pressure pulse generator;

according to an output of the monitor.

The apparatus may be configured to automatically adapt the separation and/or the pressure pulse generator. The apparatus may comprise a control system. The control system may be configured to adapt at least one of:

the separation; and/or the generator; and/or the transmission medium attribute; and/or combination/s thereof;

according to an output of the monitor.

The monitor may comprise a pressure pulse detector. For example, the control system may comprise surface pressure pulse measurement. The monitor may comprise a densimeter. The monitor may comprise a flow meter. The control system may be configured to allow optimisation of the system by way of frequency adjustment.

The control system may be configured to determine an optimum placement of the pulse reflector (e.g. separation) and/or an optimum generated pulse attribute (e.g. frequency) for a particular application of the apparatus. The control system may comprise placement/parameter software.

The control system may be configured to actively adapt the phase shift. For example, the control system may adapt a generated pulse attribute and/or the placement of the pulse reflector in response to a measured parameter/s, (e.g. a measured pressure pulse and/or a flow rate).

The apparatus may be configured to adapt the transmission medium attribute to provide the reflected pressure pulse with a phase shift with respect to the incident pressure pulse. For example, the apparatus may be configured to adapt the density of the transmission medium, such as by adapting the proportions of components of an injection fluid, to provide the reflected pressure pulse with a phase shift with respect to the incident pressure pulse. The transmission medium attribute may be adapted generally or locally, such as proximal to the pulse reflector. The transmission medium attribute may be adapted incidentally and/or intermittently and/or temporarily and/or regularly.

The apparatus may be configured to control the incident pressure pulse attribute. The incident pressure pulse attribute may be connected to a generated pulse attribute. The generated pressure pulse attribute may comprise a frequency. The generated pressure pulse attribute may comprise an amplitude. The generated pressure pulse attribute may comprise a wavelength. The generated pressure pulse attribute may comprise a speed, such as a speed of the generated pressure pulse between the generator and the pulse reflector.

The incident pulse pressure attribute may be connected to a reflected pulse attribute. The reflected pressure pulse attribute may comprise a frequency. The reflected pressure pulse attribute may comprise a wavelength. The reflected pressure pulse attribute may comprise an amplitude. The reflected pressure pulse attribute may comprise a speed, such as a speed of the reflected pressure pulse between the pulse reflector and the generator.

The incident pressure pulse attribute may be substantially the same as the generated pulse attribute. For example, the incident pressure pulse frequency may be substantially the same as the generated pressure pulse frequency. The reflected pressure pulse may comprise a frequency substantially the same as a frequency of the incident pressure pulse. By ensuring that the reflected pressure pulse comprises a frequency substantially the same as a frequency of the incident pressure pulse, the apparatus may ensure that the phase shift remains consistent, such as throughout the separation.

The incident pressure pulse attribute may be substantially the same as the reflected pulse attribute. The reflected pressure pulse attribute may comprise a proportion of an incident pressure pulse attribute. The apparatus may be configured to adapt the generated pressure pulse attribute. The apparatus may be configured to adapt the generated pressure pulse attribute in accordance with a transmission medium attribute. The apparatus may be configured to adapt the generated pressure pulse attribute in accordance with the separation. The apparatus may be configured to adapt the generated pulse pressure attribute in accordance with a transmission medium attribute.

The incident pressure pulse may comprise a portion of the generated pressure pulse. For example, the incident pressure pulse may comprise a diminished form of a generated pressure pulse (e.g. the generated pressure pulse may diminish with distance as it is transmitted over the separation towards the pulse reflector). The incident pressure pulse may comprise a combined pressure pulse. The combined pressure pulse may comprise a portion of a further order reflected pressure pulse. For example, an earlier reflected pressure pulse of an earlier incident pulse may be reflected towards the pulse reflector as a further order reflected pressure pulse. The further order reflected pressure pulse may be reflected towards the pulse reflector by the generator. The apparatus may be configured such that the further order reflected pressure pulse is out of phase with a generated pressure pulse. The apparatus may be configured such that the further order reflected pressure pulse is substantially in antiphase with a generated pressure pulse. The further order pulse may comprise a second order pulse. The further order pulse may comprise a third/fourth/fifth/etc. order pulse.

The apparatus may be configured to impart the reflected pressure pulse with a phase shift with respect to the incident pressure pulse.

The apparatus may be configured such that reflected and incident pressure pulses are minimally in phase. For example, the apparatus may be configured to prevent a first order or a second order reflected pressure pulse being in phase with a generated or an incident pressure pulse. The apparatus may be configured such that reflected and incident pressure pulses are maximally out of phase. The apparatus may be configured to prevent any reflected pressure pulse being in phase with any incident pressure pulse. The apparatus may be configured to ensure that any reflected pressure pulse is out of phase with any incident pressure pulse.

The pulse reflector may be configured so that the reflected pulse opposes the generated pulse, thereby partially resulting in the pulse transmitted uphole being reduced in amplitude. For example, the pulse reflector may be placed at a location greater than one half wavelength from the pressure pulse generator. The separation of the pulse reflector from the pulse generator may comprise a remainder greater than one half wavelength when the separation is divided by the wavelength. For example, the separation may be defined as:

$$S>m\lambda+(0.5*\lambda) \quad \text{Eq (1)}$$

Where S is the separation; m is a whole number and λ is the wavelength.

The pulse reflector may be configured so that the reflected pulse enhances the generated pulse, thereby partially resulting in the pulse transmitted downhole being increased in amplitude. For example, the pulse reflector may be placed at a location at or below one half wavelength from the pressure pulse generator. The separation of the pulse reflector from the pulse generator may comprise a remainder equal to or less than one half wavelength when the separation is divided by the wavelength. For example, the separation may be defined as:

$$S\leq m\lambda+(0.5*\lambda) \quad \text{Eq. (2)}$$

Where S is the separation; m is a whole number and λ is the wavelength.

The pulse reflector may be configured to reflect the portion of the incident pressure pulse. The pulse reflector may be configured to at least partially absorb the incident pressure pulse. The pulse reflector may comprise a baffle. The pulse reflector may be configured to absorb a proportion of the incident pressure pulse. The pulse reflector may be configured to absorb a portion of an energy of the incident pressure pulse. The pulse reflector may be configured to transform an energy portion of the incident pressure pulse. For example, the pulse reflector may comprise an energy converter for converting the energy portion of the pressure pulse (e.g., into heat and/or kinetic energy). The pulse reflector may be configured to modulate the incident pressure pulse. The pulse reflector may comprise a reflective member. The pulse reflector may comprise a plate. The pulse reflector may comprise an orifice plate.

The apparatus may be configured to provide an offset between the generated pressure pulse from the generator and the reflected pressure pulse from the pulse reflector.

The pulse reflector may be located downhole. The pulse reflector may be located proximal to the surface. The pulse reflector may be located proximal to the generator. The pulse reflector may be located distal to the surface. The pulse reflector may be located distal to the generator.

The reflected pressure pulse may comprise an amplitude substantially different from a amplitude of the generated pressure pulse. The reflected pressure pulse may comprise an amplitude substantially lower than the amplitude of the generated pressure pulse. The reflected pressure pulse amplitude may comprise a fraction of the generated pressure pulse amplitude. For example, the reflected pressure pulse amplitude may be half of the generated pressure pulse amplitude. The pulse reflector may be configured to vary the reflected pressure pulse amplitude dependent on the generated pressure pulse amplitude. For example, the pulse reflector may store the energy from the generated pressure pulse, such as the energy from greater amplitude pulses. The reflected pressure pulse amplitude may be substantially greater than the generated pressure pulse amplitude. The pulse reflector may be configured to vary the reflected pressure pulse amplitude dependent on the generated pressure pulse amplitude. The pulse reflector may be configured to vary the reflected pressure pulse amplitude dependent on the combined pressure pulse.

The reflected pressure pulse may comprise a frequency substantially different from a frequency of the generated pressure pulse. For example, the pulse reflector may comprise a frequency convertor. By ensuring that the reflected pressure pulse comprises a frequency substantially different from a frequency of the generated pressure pulse, the apparatus may ensure that a combined pressure pulse, the combined pressure pulse comprising reflected and incident pressure pulses variously along the separation, is of variable magnitude.

The generator and the pulse reflector may be formed and arranged for simultaneous transport downhole. For example the apparatus may comprise a toolstring, the generator and the pulse reflector being connected to the toolstring.

According to a second aspect of the invention there is provided a method of transmitting pressure pulses downhole, the method comprising:

generating a pressure pulse:

reflecting at least a portion of an incident pressure pulse at a pulse reflector as a reflected pressure pulse; and controlling a phase shift of the reflected pressure pulse with respect to the incident pressure pulse.

The method may comprise providing the reflected pressure pulse with a phase shift with respect to the incident pressure pulse.

The method may comprise providing the reflected pressure pulse with substantially no phase shift with respect to the incident pressure pulse.

The method may comprise providing the pulse reflector at a separation from the generator.

The method may comprise containing the pressure pulse downhole.

The method may comprise defining the separation. Defining the separation may comprise predetermining the separation. Defining the separation may comprise adapting the separation. The method may comprise defining the separation according to a pressure pulse attribute.

The method may comprise defining an attribute of the pressure pulse. Defining the attribute of the pressure pulse may comprise predetermining the attribute of the pressure pulse. Defining the attribute of the pressure pulse may comprise adapting the attribute of the pressure pulse. The method may comprise defining the attribute of the pressure pulse according to the separation.

The method may comprise adapting the generation of the pressure pulse according to the separation and/or a pressure pulse attribute. For example, the method may comprise adapting the generation of the pressure pulse according to the separation and a pressure pulse speed. The method may comprise adapting the generation of the pressure pulse according to the separation and a pressure pulse speed such that a wavelength of the pressure pulse is not an arithmetic factor of the separation (i.e. the separation is not wholly divisible by the wavelength).

The method may comprise adapting the separation according to a pressure pulse attribute. The pressure pulse attribute may comprise the pressure pulse speed. The pressure pulse attribute may comprise the pressure pulse frequency.

The pressure pulse attribute may be variable with a transmission medium attribute. For example, the pressure pulse speed may vary with a density of a fluid medium. The method may comprise adapting the generation of the pressure pulse according to the transmission medium attribute.

The phase shift may be controlled. The phase shift may be predetermined. The phase shift may be actively controlled.

According to a third aspect of the invention there is provided a downhole apparatus comprising:

a signal source; and a signal boundary member;

wherein the apparatus is configured such that at least a portion of an incident signal received at the boundary member is reflected by the boundary member as a reflected signal, and the apparatus is configured to control a phase shift of the reflected signal with respect to the incident signal.

The apparatus may be configured to provide the reflected signal with a phase shift with respect to the incident signal.

The apparatus may be configured to provide the reflected signal with substantially no phase shift with respect to the incident signal.

The signal may comprise a pressure pulse. The signal source may comprise a pressure pulse generator.

The signal boundary member may comprise a pulse reflector.

According to a fourth aspect of the invention there is provided a method of transmitting a signal downhole, the method comprising:

generating a signal;

reflecting at least a portion of an incident signal at a signal boundary member as a reflected signal; and controlling a phase shift of the reflected signal with respect to the incident signal.

The method may further comprise providing the reflected signal with a phase shift with respect to the incident signal.

The method may further comprise providing the reflected signal substantially no phase shift with respect to the incident signal.

The invention includes one or more corresponding aspects, embodiments or features in isolation or in various combinations whether or not specifically stated (including claimed) in that combination or in isolation. For example, it will readily be appreciated that features recited as optional with respect to one aspect may be additionally applicable with respect to any other aspect, without the need to explicitly and unnecessarily list those various combinations and permutations here. For example, features of the downhole apparatus of the first aspect may be combined with the downhole apparatus of the third aspect.

It will be appreciated that one or more embodiments/aspects may be useful in transmitting/controlling a pressure pulse downhole.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
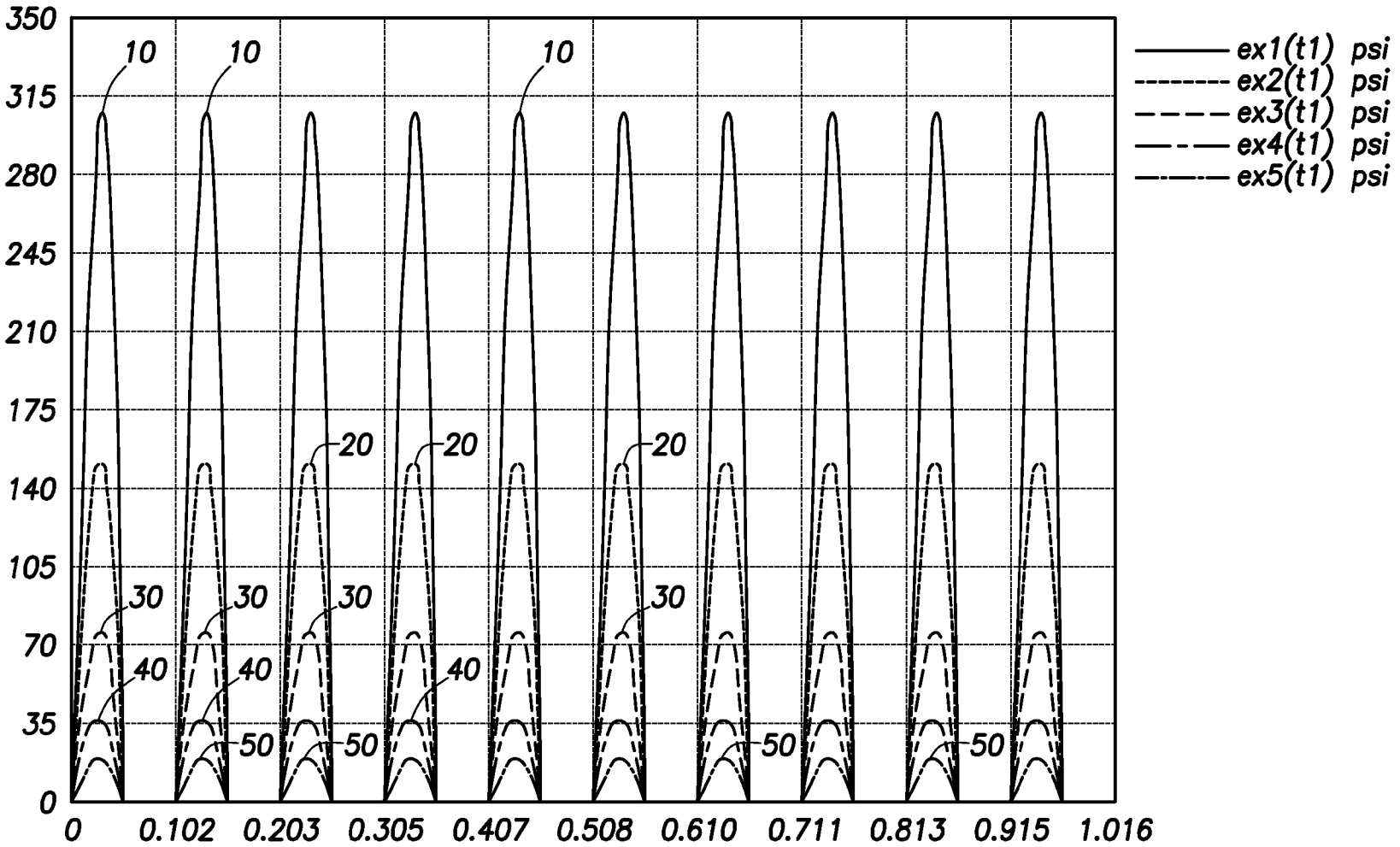
FIG. 1 is a graphic representation of generated and reflected pressure pulses in phase.
Figure 2:
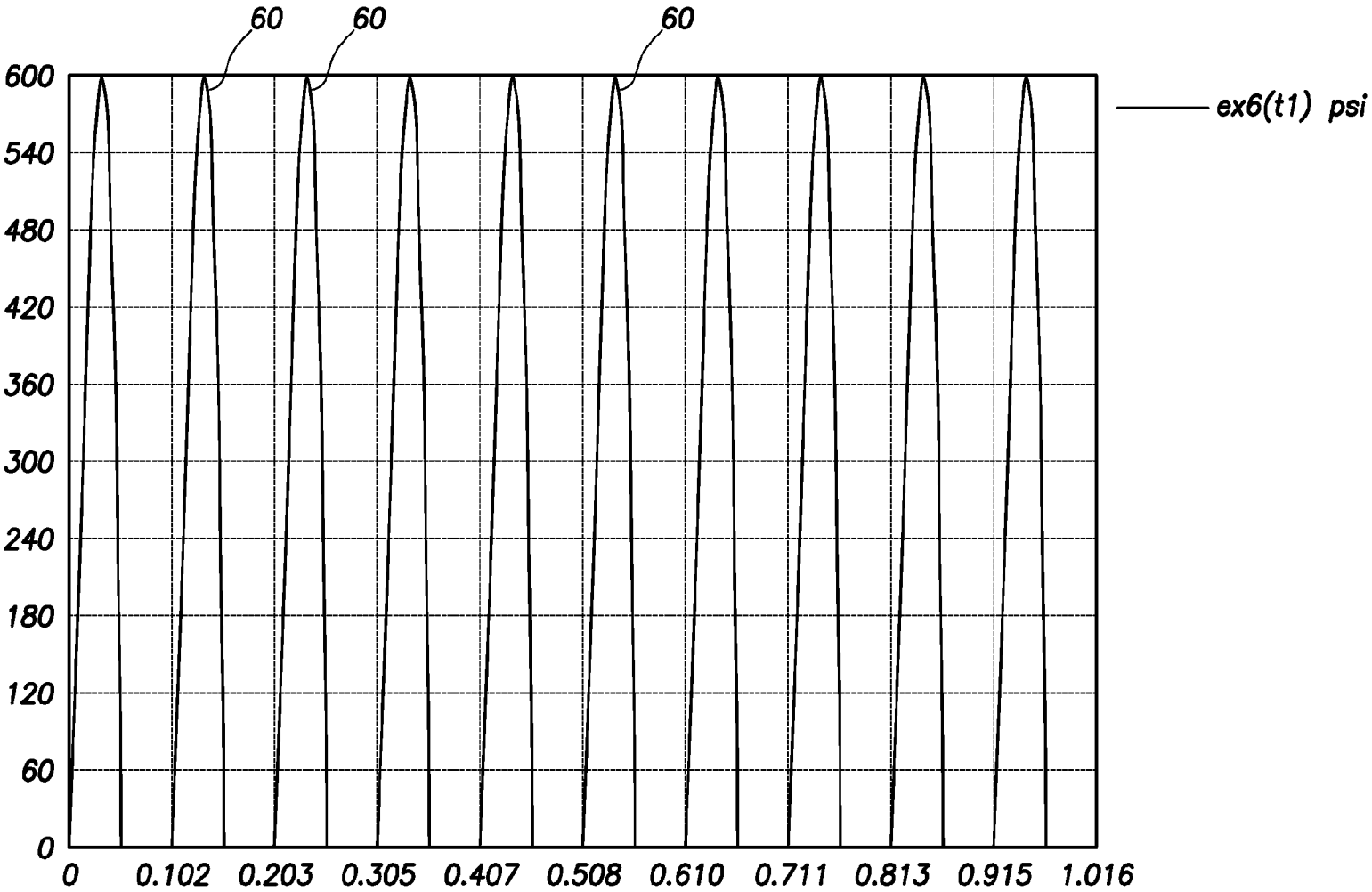
FIG. 2 is a graphic representation of a combined pulse comprising the generated and reflected pressure pulses of FIG. 1.
Figure 3:
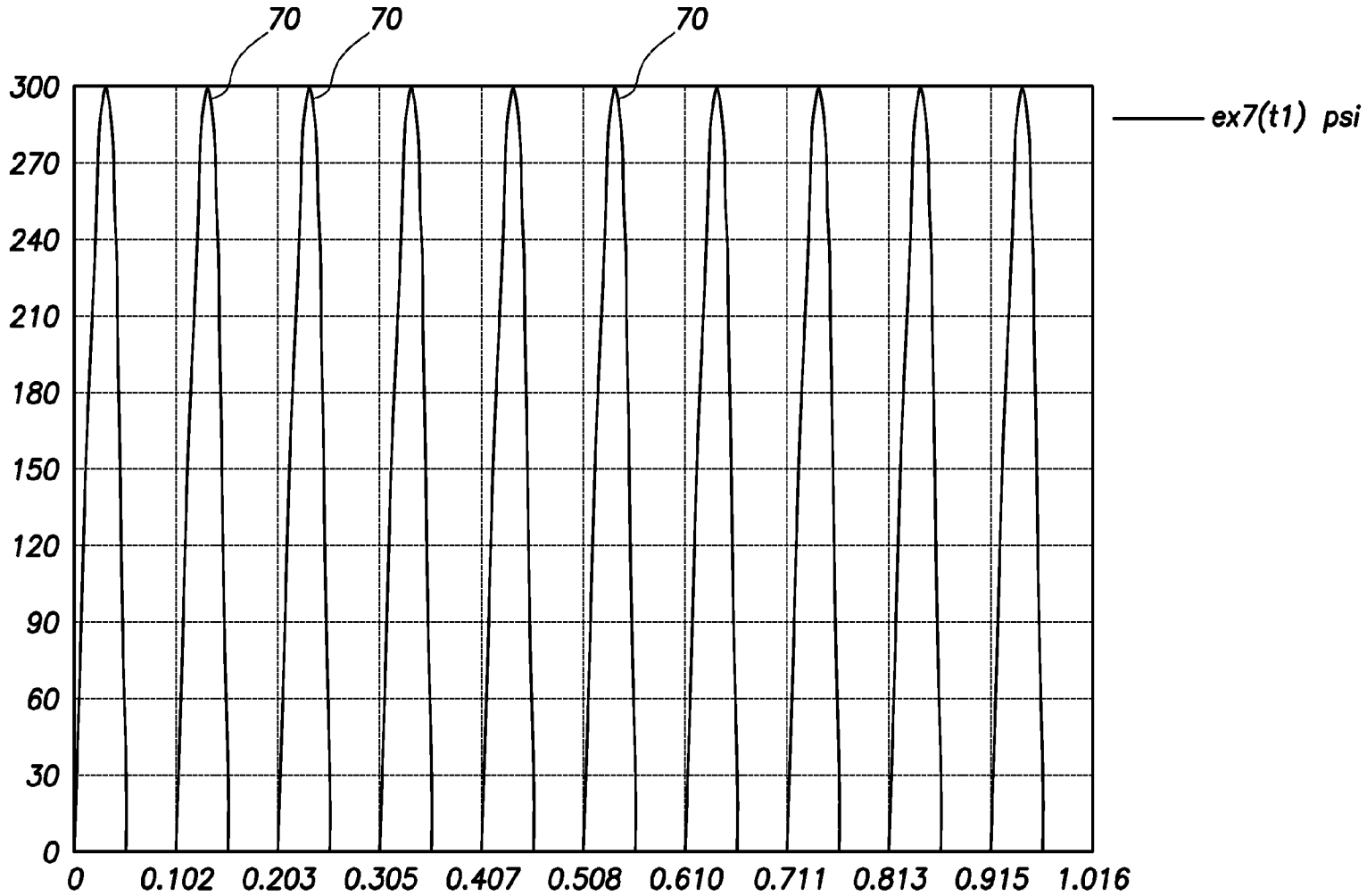
FIG. 3 is a graphic representation of the combined pulse of FIG. 2 at a surface location.

Reference is first made to FIGS. 1 to 3 in which there are shown graphic representations of generated and reflected pressure pulses in phase (amplitude in psi along vertical axis, time in seconds along horizontal axis). The pressure pulses are generated downhole. FIG. 1 shows the magnitude over time of the generated and reflected pressure pulses separately. Generated pressure pulses 10 are generated at a generator. Earlier generated pulses that have travelled away from the generator, have been reflected back towards the generator, and have subsequently been further reflected at the generator are represented as second order reflected pulses 20. That is, the second order reflected pulses 20 result from earlier generated pulses 10 that have been reflected twice. Similarly, the fourth order reflected pulses 30 result from earlier reflected pulses 20 that have been further reflected twice; the sixth order reflected pulses 40 result from earlier reflected pulses 30 that have been further reflected twice; and the eighth order reflected pulses 50 result from earlier reflected pulses 40 that have been further reflected twice.

The reflected pulses 20, 30, 40, 50 have initially been reflected, such as by a pulse reflector uphole of the generator, back towards the generator and then subsequently further reflected at the pressure pulse generator. Passage of the pulses 20, 30, 40, 50 between the generator and the pulse reflector diminishes the pulses 20, 30, 40, 50. Reflection of the pulses 20, 30, 40, 50, such as by the generator and the pulse reflector, diminishes the pulses 20, 30, 40, 50. Accordingly, the magnitude of the reflected pulses 20, 30, 40, 50 is diminished successively; each higher order reflected pulse being proportionally less than its predecessor pulse.

FIG. 2 shows downhole combined pulses 60 resultant from a constructive interference of the generated and reflected pulses 10, 20, 30, 40, 50 of FIG. 1. As the pulses 10, 20, 30, 40, 50 are all in phase, the downhole combined pulse 60 have a maximum magnitude (amplitude) corresponding to the sum of the maximum amplitudes of the component pulses 10, 20, 30, 40, 50.

FIG. 3 shows surface combined pulses 70 resulting from the passage of the downhole combined pulses 60 of FIG. 2 uphole to a surface. The magnitude of the surface combined pulses 70 is diminished with respect to the magnitude of the downhole combined pulses 60, due to losses over the distance between the surface and downhole, such as due to friction, reflection, absorption, etc.

Figure 4:
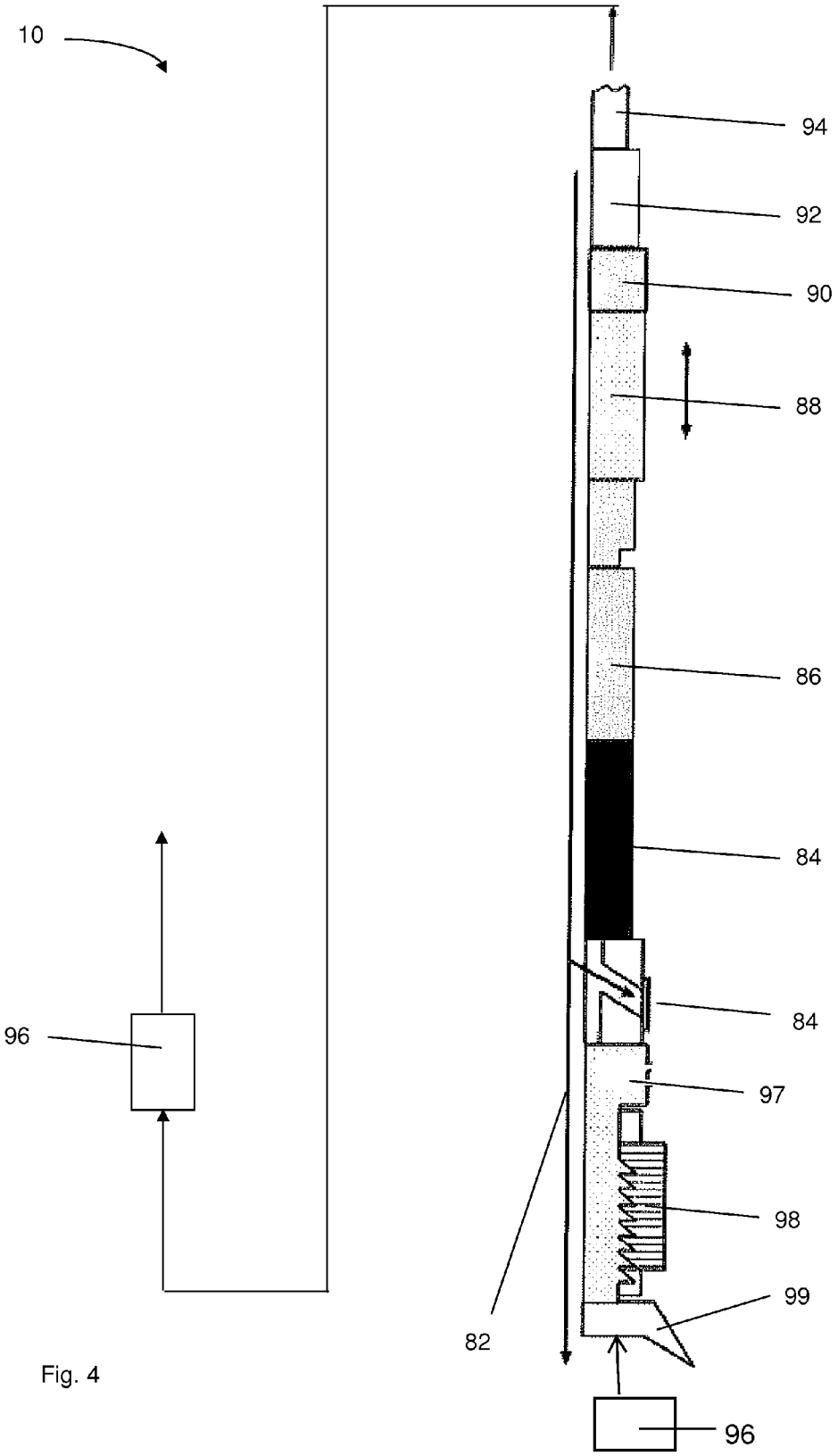
FIG. 4 is a representation of a partial cross-section of a downhole apparatus for use in generating pressure pulses downhole in accordance with an embodiment of the invention.

FIG. 4 is a representation of a partial cross-section of a downhole apparatus 80 for use in generating pressure pulses downhole in accordance with an embodiment of the invention. The apparatus 80 comprises a flowpath 82 for the passage of fluids up or downhole, such as drilling muds in a bore. Only one side of the apparatus 80 has been shown for clarity; however it will be appreciated that the apparatus comprises a second side such that the flowpath 82 is substantially enclosed. The apparatus 80 comprises a Pulse Generator 84 that can be used to assist in drilling to access subsurface hydrocarbon-bearing formations; or in assisting the passage of tubing, tools and devices through bores. The Pulse Generator 84 is connected to a Pulse Generator shock sub 86, a drilling jar 88, a buffer sub 90 and a string connector 92. The string connector 92 connects the Pulse Generator 84 in a tool string 94, with a pulse reflector 96 connected in the tool string 94 uphole of the Pulse Generator 84. The separation of the pulse reflector 96 from the Pulse Generator 84 is predetermined and remains substantially constant throughout. The apparatus 80 further comprises a spear mandrel 97, a releasing spear 98 and a hydraulic seal rubber packer 99.

During operations, fluid is pumped through the flowpath 82 to activate the Pulse Generator 84. The Pulse Generator 84 generates pressure pulses dependent on a rate of flow of the fluid. The pressure pulses travel uphole where they are partially reflected at the pulse reflector 96. The reflected pressure pulses travel downhole from the pulse reflector 96 towards the Pulse Generator 84, where they are reflected back towards the pulse reflector 96. The pressure pulses diminish in amplitude during passage and reflection. The frequency of the pressure pulses, the speed of transmission of the pressure pulses through the fluid and the separation of the pulse reflector 96 from the Pulse Generator 84 determines whether the generated and reflected pulses are in or out of phase.

The apparatus 80 comprises a control system (not shown) that controls the frequency. The density of the fluid in the flowpath 82 is monitored and input to the control system. A relationship between the fluid density and a speed of the pressure pulses through the fluid is provided as an input to the control system. The pulse speed may also be affected by the flexibility of the drilling system. The separation between the pulse reflector 96 and the Pulse Generator 84 is input to the control system, such that the control system can determine an offset between generated and reflected pulses, according to:

$$\text{Offset} = \frac{2 \times \text{separation}}{\text{pulse speed}} \qquad \text{Eq. (3)}$$

The control system adapts the flow rate of fluid in the flowpath 82 such that the Pulse Generator 84 generates pressure pulses with a frequency that corresponds to a wavelength in the particular fluid that is not a whole factor of the separation. Accordingly, the control system ensures that undesired pressure pulse frequencies are avoided that would result in a maximised constructive interference between generated and reflected pulses such frequencies being determined according to integer multiples of:

$$\frac{\text{pulse speed}}{2 \times \text{separation}} \qquad \text{Eq. (4)}$$

The control system determines such undesired frequencies and establishes midpoints between each undesired frequency; the midpoints corresponding to desired frequencies of minimal constructive interference. The control system adjusts the flow rate to the Pulse Generator 84 such that the Pulse Generator 84 generates pressure pulses with desired frequencies. A densimeter (not shown), for monitoring the density of the fluid, is connected to the control system. Accordingly, the control system adjusts the frequency in response to changes in fluid density to ensure a minimal constructive interference of generated and reflected pulses. Thus the maximum amplitude combined pulses 60 and 70 of FIGS. 2 and 3 can be avoided.

Figure 5:
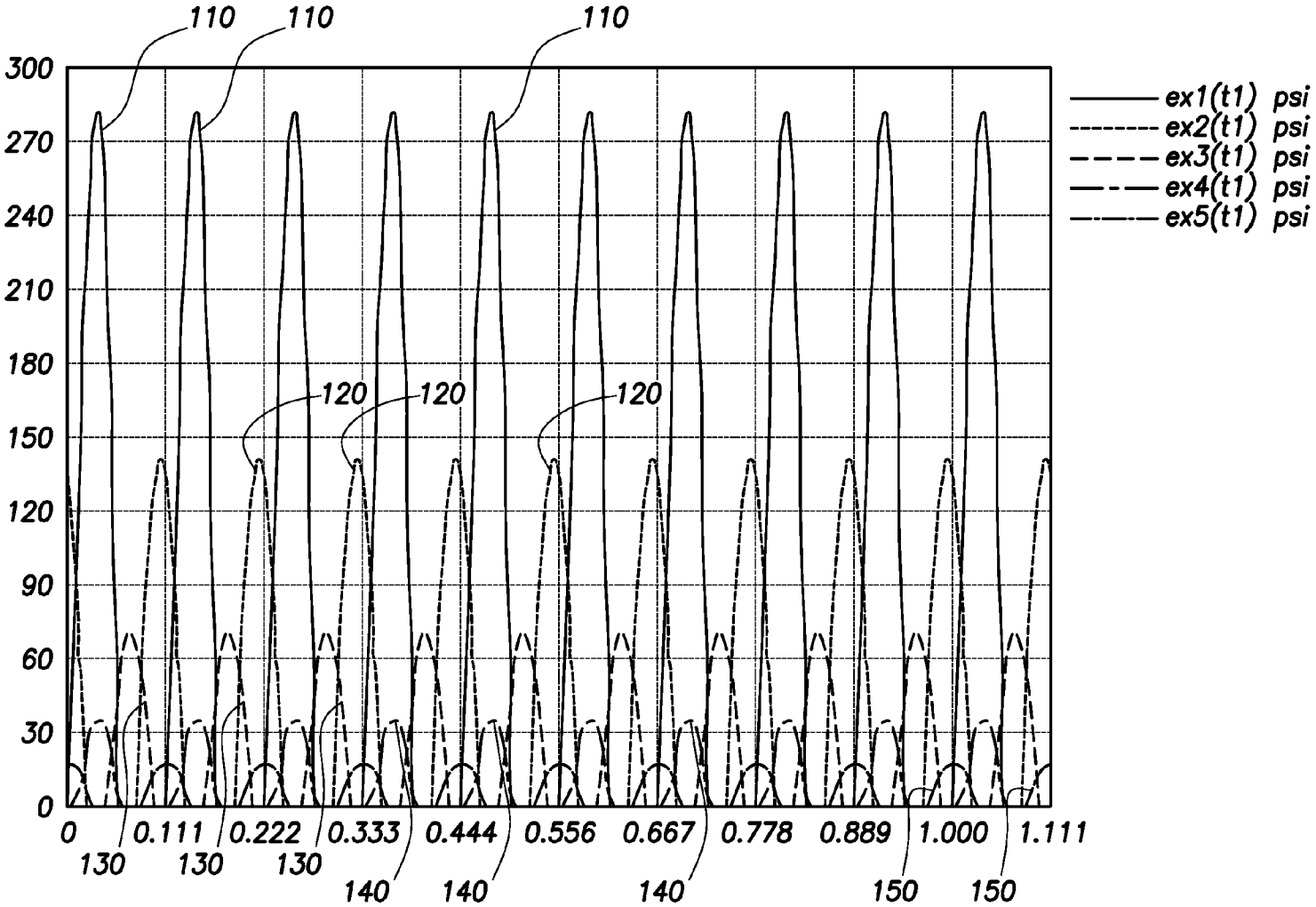
FIG. 5 is a graphic representation of generated and reflected pressure pulses of the downhole apparatus of FIG. 4.
Figure 6:
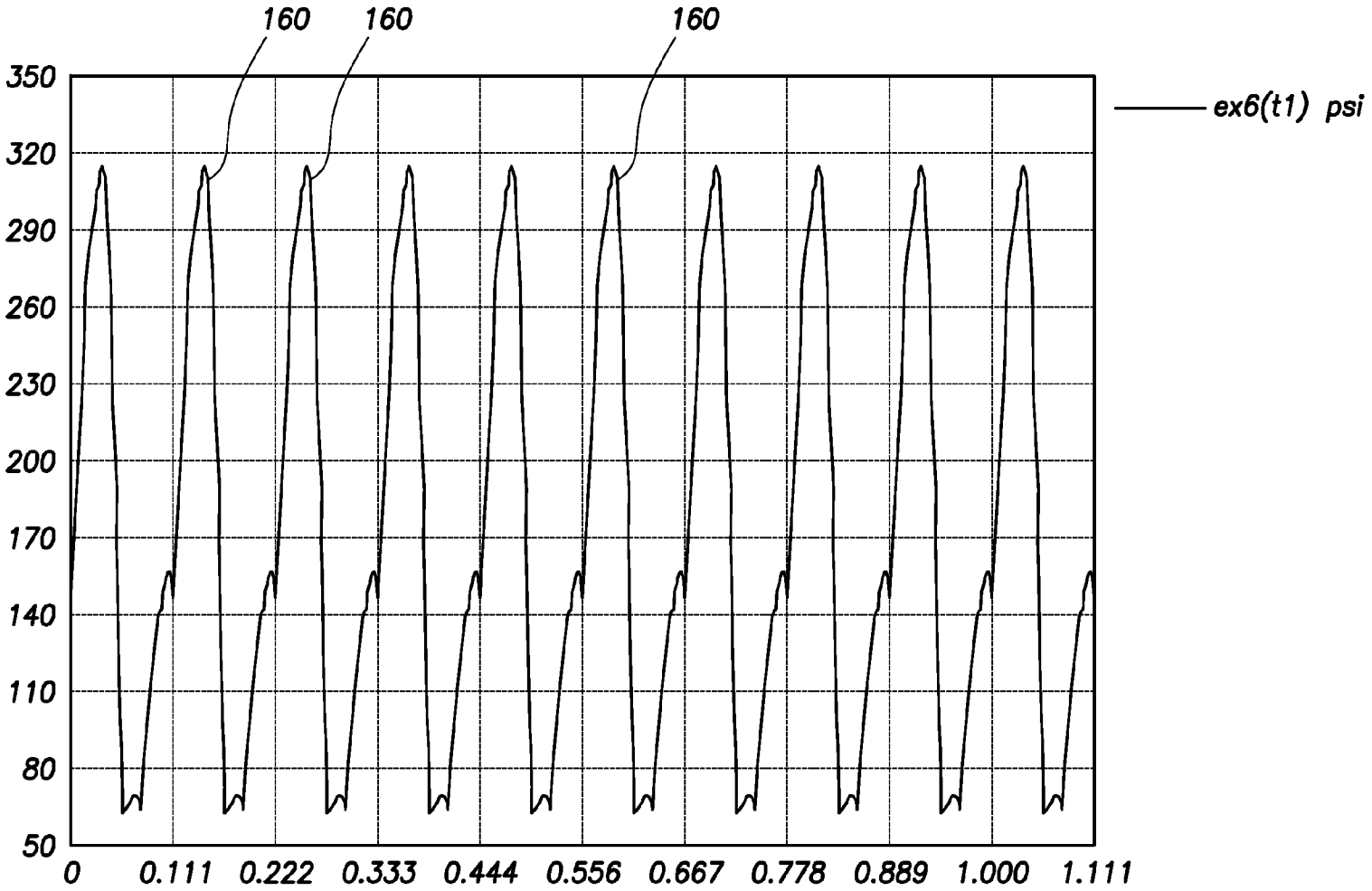
FIG. 6 is a graphic representation of a combined pulse comprising the generated and reflected pressure pulses of FIG. 5.
Figure 7:
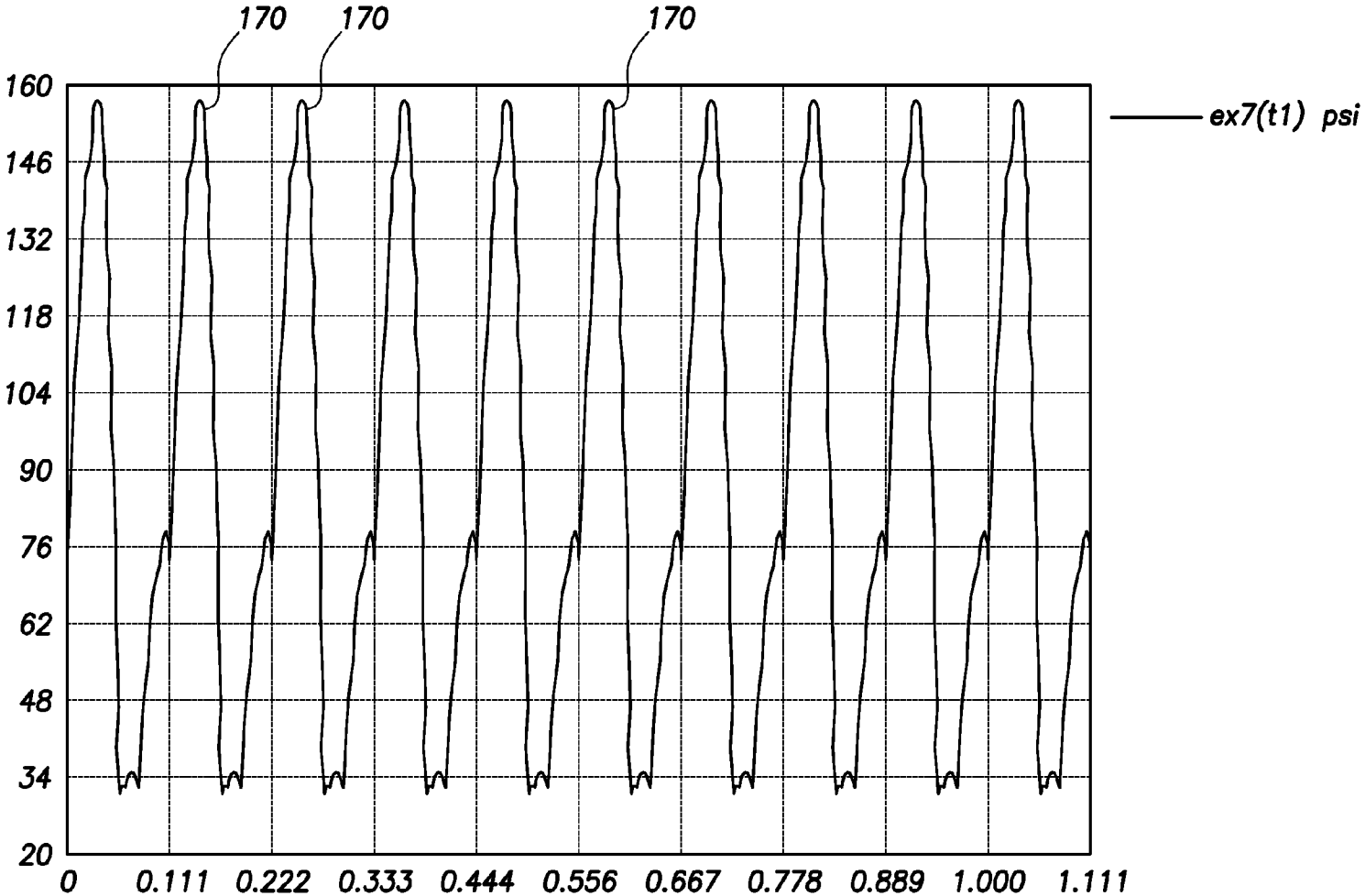
FIG. 7 is a graphic representation of the combined pulse of FIG. 6 at a surface location.

FIGS. 5 to 7 show graphic representations of generated and reflected pressure pulses out of phase, as produced by the apparatus of FIG. 4 (amplitude in psi along vertical axis, time in seconds along horizontal axis). FIG. 5 shows the magnitude over time of the generated and reflected pressure pulses separately. Generated pressure pulses 110 have been generated by the Pulse Generator 84. Earlier generated pulses that have travelled away from the Pulse Generator, have been reflected back towards the Pulse Generator, and have subsequently been further reflected at the Pulse Generator are represented as second order reflected pulses 120. That is, the second order reflected pulses 120 result from earlier generated pulses 110 that have been reflected twice. Similarly, the fourth order reflected pulses 130 result from earlier reflected pulses 120 that have been further reflected twice; the sixth order reflected pulses 140 result from earlier reflected pulses 130 that have been further reflected twice; and the eighth order reflected pulses 150 result from earlier reflected pulses 140 that have been further reflected twice.

The reflected pulses 120, 130, 140, 150 have initially been reflected by the pulse reflector 96 uphole of the Pulse Generator 84, back towards the Pulse Generator 84 and then subsequently further reflected at the pressure pulse Pulse Generator 84. Passage of the pulses 120, 130, 140, 150 between the Pulse Generator 84 and the pulse reflector 96 diminishes the pulses 120, 130, 140, 150. Reflection of the pulses 120, 130, 140, 150, such as by the Pulse Generator 84 and the pulse reflector 96, diminishes the pulses 120, 130, 140, 150. Accordingly, the magnitude of the reflected pulses 120, 130, 140, 150 is diminished successively; each higher order reflected pulse being proportionally less than its predecessor pulse. Compared to the pressure pulses 10, 20, 30, 40, 50 of FIG. 1, it can be seen that the reflected pressure pulses 120, 130, 140, 150 are out of phase with the generated pressure pulses 110. FIG. 5 also shows that the reflected pressure pulses 120, 130, 140, 150 are out of phase with each other 120, 130, 140, 150.

FIG. 6 shows downhole combined pulses 160 resultant from a constructive interference of the generated and reflected pulses 110, 120, 130, 140, 150 of FIG. 5. As the pulses 110, 120, 130, 140, 150 are substantially out of phase, the downhole combined pulses 160 have a maximum magnitude (amplitude) corresponding substantially to a substantially less than a sum of the maximum amplitudes of the component pulses 110, 120, 130, 140, 150.

FIG. 7 shows surface combined pulses 170 resulting from the passage of the downhole combined pulses 160 of FIG. 6 uphole to a surface. The magnitude of the surface combined pulses 170 is diminished with respect to the magnitude of the downhole combined pulses 160, due to losses over the distance between the surface and downhole, such as due to friction, reflection, absorption, etc. As the surface pressure pulses 170 of FIG. 7 are considerably less than the surface pressure pulses 70 of FIG. 3, any surface equipment is exposed to lesser pressure pulses with the apparatus of FIG. 4. Accordingly, any surface equipment is less likely to suffer, such as damage or interference, when used in conjunction with the apparatus of FIG. 4.

It should be understood that the embodiments described herein are merely exemplary and that various modifications may be made thereto without departing from the scope of the invention. For example, although shown here with a Pulse Generator. It will be appreciated that other embodiments of the present invention comprise other downhole pressure pulse generators. Where the embodiment shown here comprises a jar, it will be appreciated that alternative embodiments of the present invention need not comprise a jar, or may comprise another device such as a fishing tool. Similarly, where shown here with a shock-sub, it will be appreciated that alternative embodiments of the present invention need not comprise a shock-sub. Although shown here as being beneficial for surface equipment, it will be appreciated that other equipment, such as equipment uphole of an uphole, or downhole of a downhole pulse reflector, may benefit from the present invention. Likewise, where the apparatus shown here provides a phase shift, it will readily be appreciated that other apparatus may be configured to provide no phase shift. For example, where it is desired to maximise a pulse, such as adjacent an agitator, or a signal transmitted to the surface, a pulse reflector may be located downhole to reflect a pulse in phase with a generated pulse, such as to increase the amplitude of the agitation, or the signal received at the surface.

What is claimed is:

1. A downhole apparatus comprising:

a tool string having a flow path therethrough;

a pressure pulse generator in fluid communication with the flow path to receive fluid therefrom for generating pressure pulses in the flow path; and a pulse reflector in fluid communication with the generator via the flow path to reflect at least a portion of an incident pressure pulse from the generator as a reflected pressure pulse at a phase shift thereto;

wherein said pulse reflector is positioned at a separation from said pulse generator, wherein said separation the phase shift of the reflected pressure pulse with respect to the incident pressure pulse reduces the amplitude of a pressure pulse transmitted beyond the reflector away from the generator.

2. The apparatus of claim 1, wherein the generator comprises a downhole drilling tool.

3. The apparatus of claim 1, wherein the generator comprises an agitator.

4. The apparatus of claim 1, wherein the apparatus is configured such that the reflected pressure pulse is substantially in antiphase with the incident pressure pulse.

5. The apparatus of claim 1, wherein the apparatus is configured to reduce a constructive interference.

6. The apparatus of claim 1, wherein the reflected pressure pulse is directed towards the generator.

7. The apparatus of claim 1, wherein the pulse reflector is located uphole of the generator.

8. The apparatus of claim 1, wherein the reflected pressure pulse is provided with the phase shift with respect to the incident pressure pulse.

9. The apparatus of claim 1, wherein the incident pressure pulse and the reflected pressure pulse are always out of phase along the separation between the pressure pulse generator and the pulse reflector.

10. The apparatus of claim 1, wherein the generator is adaptable according to an incident pressure pulse attribute.

11. The apparatus of claim 10, wherein the incident pressure pulse attribute comprises a frequency.

12. The apparatus of claim 10, wherein the incident pressure attribute comprises a speed.

13. The apparatus of claim 1, wherein the separation between the generator and the pulse reflector generates a destructive interference between the incident pressure pulse and the reflected pressure pulse.

14. The apparatus of claim 13, wherein one of the separation and a generated pulse attribute is adaptable on the basis of the other of the generated pulse attribute and the separation.

15. The apparatus of claim 13, wherein at least one of the separation and the pressure pulse generator is adaptable to accommodate a speed of the incident pressure pulse between the generator and the pulse reflector.

16. The apparatus of claim 13, wherein the separation accommodates a transmission medium between the generator and the pulse reflector.

17. The apparatus of claim 16, wherein the separation is determined according to a transmission medium attribute.

18. The apparatus of claim 17, wherein at least one of the separation and the pressure pulse generator is adaptable according to the transmission medium attribute.

19. The apparatus of claim 18, wherein the separation and/or the pressure pulse generator is automatically adaptable.

20. The apparatus of claim 16, wherein the apparatus comprises a transmission medium monitor.

21. The apparatus of claim 20, further comprising a control system, the control system to adapt at least one of the separation, the generator, a transmission medium attribute, and combinations thereof according to an output of the monitor.

22. The apparatus of claim 13, wherein a generated pressure pulse attribute is adaptable in accordance with the separation.

23. The apparatus of claim 13, wherein a generated pulse pressure attribute is adaptable in accordance with a transmission medium attribute.

24. The apparatus of claim 1, wherein the incident pressure pulse comprises a portion of a second order reflected pressure pulse.

25. The apparatus of claim 1, wherein reflected and incident pressure pulses are minimally in phase.

26. The apparatus of claim 1, the reflected and incident pressure pulses are maximally out of phase.

27. The apparatus of claim 1, wherein the pulse reflector at least partially absorbs the incident pressure pulse.

28. The apparatus of claim 1, wherein the generator and the pulse reflector are formed and arranged for simultaneous transport downhole.

29. A method of transmitting pressure pulses downhole, the method comprising:

generating a pressure pulse with a pulse generator;

positioning a pulse reflector at a separation from said pulse generator;

reflecting at least a portion of an incident pressure pulse at said pulse reflector as a reflected pressure pulse; and reducing an amplitude of a pressure pulse transmitted beyond the reflector away from the generator by positioning the pulse reflector such that the separation ensures that the reflected pressure pulse is provided with a phase shift with respect to the incident pressure pulse.

30. A downhole apparatus comprising:

a downhole tool having a flow path therethrough;

a signal source in fluid communication with the flow path to receive fluid therefrom; and a signal boundary member in fluid communication with the signal source via the flow path, at least a portion of an incident signal received at the boundary member reflected by the boundary member as a reflected signal at a phase shift thereto;

wherein the signal boundary member is positioned at a separation from the signal source wherein said separation the phase shift of the reflected signal with respect to the incident signal reduces an amplitude of a signal transmitted beyond the signal boundary member away from the signal source.

31. A method of transmitting a signal downhole, the method comprising:

generating a signal with a signal source;

reflecting at least a portion of an incident signal at a signal boundary member as a reflected signal at a desired phase shift thereto; and controlling the phase shift of the reflected signal with respect to the incident signal by positioning the signal source and said signal boundary member with a separation there between, such that said separation provides the reflected signal with the desired phase shift to reduce an amplitude of a signal transmitted beyond the signal boundary member away from the signal source.

* * * * *